United States Patent [19]

Peters

[11] 4,416,102

[45] Nov. 22, 1983

[54] PLASTIC BUSHING FOR USE WITH STEEL/WOOD TRUSS STRUCTURES

[76] Inventor: Dierk D. Peters, 16526 Zumaque St., Rancho Santa Fe, Calif. 92067

[21] Appl. No.: 182,952

[22] Filed: Sep. 2, 1980

[51] Int. Cl.[3] ..... E04C 3/02

[52] U.S. Cl. ..... 52/692; 52/693

[58] Field of Search ..... 52/692, 693, 694, 642, 52/639; 403/224, 298, 292, 158; 29/523, 524

[56] References Cited

U.S. PATENT DOCUMENTS

| | | | |
|---|---|---|---|
| 2,819,105 | 1/1958 | Behuke | 403/224 |
| 3,333,874 | 8/1967 | Gelfarb | 52/693 UX |
| 3,531,903 | 10/1970 | Swanson | 29/523 X |
| 3,883,258 | 5/1975 | Hewson | 403/298 |
| 3,946,532 | 3/1976 | Gilb | 52/692 |
| 4,071,941 | 2/1978 | Sweet | 52/693 X |
| 4,094,116 | 6/1978 | Gilb | 52/693 |

*Primary Examiner*—Carl D. Friedman

*Attorney, Agent, or Firm*—Knobbe, Martens, Olson & Bear

[57] ABSTRACT

A cylindrical resilient plastic bushing having a central bore fits coaxially within the wooden chord openings of a single or double chord truss joist. The bushing bores are sized to receive the metal pins of the joist which fasten the metal webs to the chord section. The insertion of the pin slightly expands the resilient bushing thereby providing for a full fit of the pin within the bushing and securely locking the bushing within the chord. The bushing distributes the shear and compression loads over the wooden chords and absorbs vibrations acting on the truss.

12 Claims, 14 Drawing Figures

Fig. 1
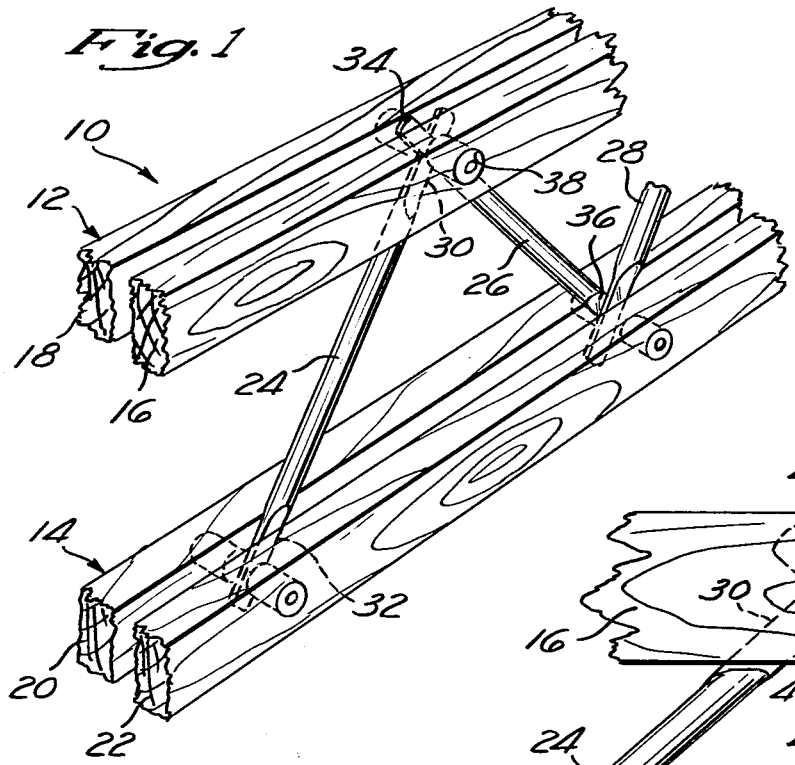
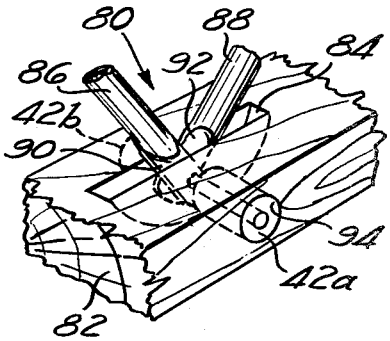
Fig. 2
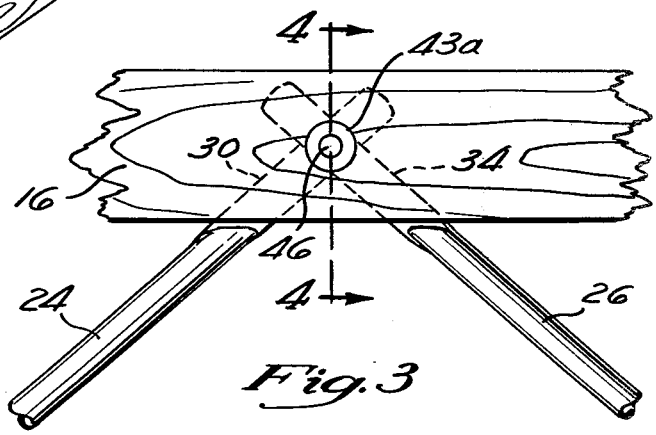
Fig. 3
Fig. 4
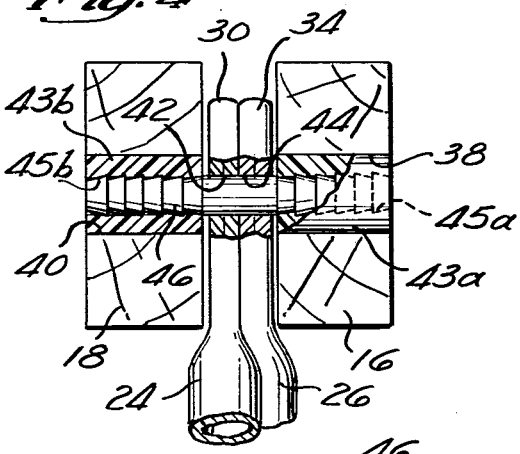
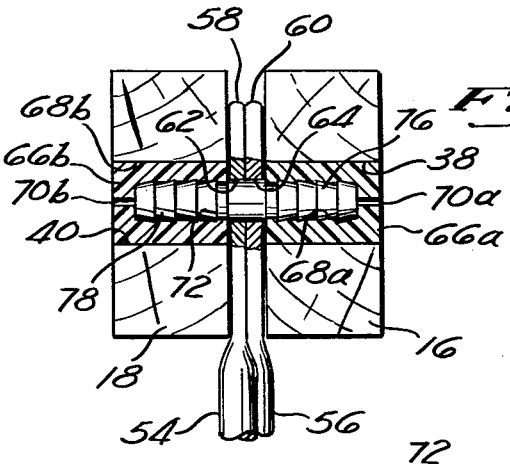
Fig. 5
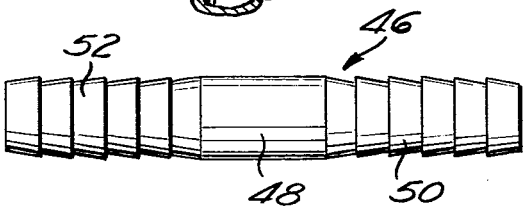
Fig. 6
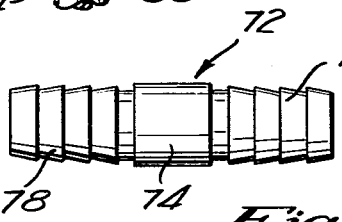
Fig. 7
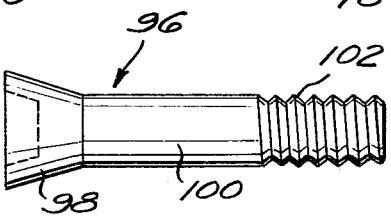
Fig. 8

Fig. 9
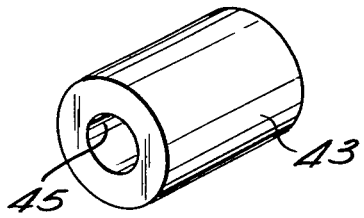
Fig. 10
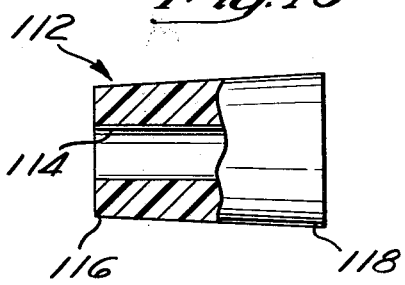
Fig. 11
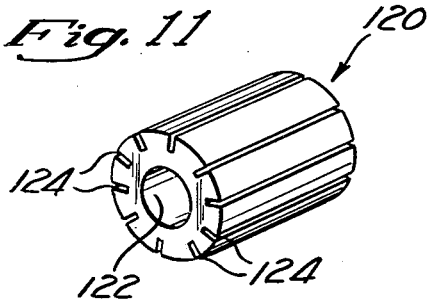
Fig. 12
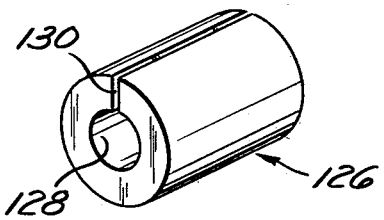
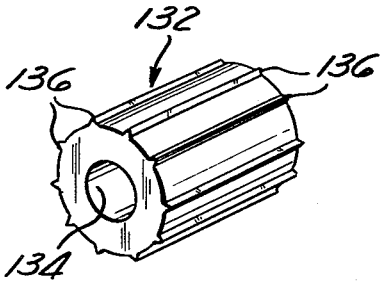
Fig. 13
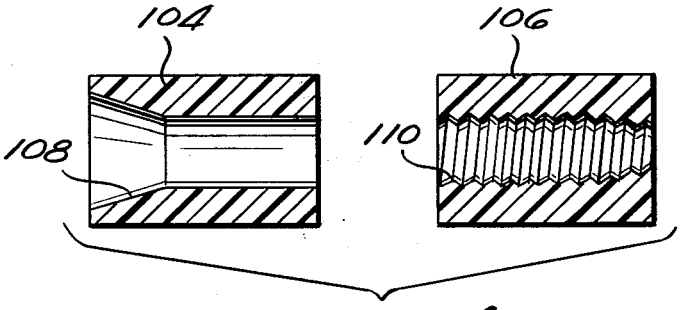
Fig. 14

PLASTIC BUSHING FOR USE WITH STEEL/WOOD TRUSS STRUCTURES

BACKGROUND OF THE INVENTION

The invention is generally directed to truss joists constructed from metal webs and lumber chords well known as a structural member for use in bridges and buildings for over 100 years.

Two basic types of truss joists are the single chord and double chord truss. A standard double chord truss joist has two spaced chord sections with each chord section comprising two juxtaposed lumber sections placed side by side parallel to each other. Each lumber section has registered openings. Metal webs diagonally span these chord sections usually in zig-zag fashion with adjacent web ends being overlapped. Each end of the webs is flattened and has a central aperture registered between the juxtaposed lumber section openings of each chord. Metal pins extend through these apertures into the lumber section openings thereby fastening the webs to the wooden chords.

A standard single chord truss joist assembly has two spaced chord sections each having an opposing face which is slotted. Each of the chord sections also has a transverse opening drilled through the section in communication with the slot. Metal webs, of the same type as discussed above, diagonally span the chord sections in overlapping zig-zag fashion. The flattened apertured web ends extend into the chord slots and are secured to the chords by a pin which passes through the transverse chord section opening and the apertured web end.

The pins are typically retained within the single and double trusses by means of an external assembly, such as a locking washer, which fits over each end of the pin protruding from the wooden chords. Such external assemblies, although satisfactory, may interfere with use of the trusses in construction or may become dislodged. There is, therefore, a need for a pin/chord assembly which will provide for automatic and effective locking of the pin within the chord opening upon insertion.

Secondly, unbalanced or impact loads on the truss have produced vibrational problems in the past. Moreover, the truss is not constructed to provide dampening of undesirable noise created by the working of the truss. Thus, a mechanism that would absorb vibrations and sound would be quite advantageous.

Finally, although the pin and the steel web members are capable of sustaining very high stresses, problems have resulted in the past because the wood chord has a tendency to split at the joint. In fact, occasionally the metal pin will damage the wooden chord simply upon insertion. Although the low stress value, due to wood chord splitting, has been a well-identified problem for several years, the truss industry has yet to devise a satisfactory solution.

U.S. Pat. Nos. 3,985,459 and 3,946,532 disclose perforated plates having a plurality of tooth-like projections which mount the plates to the truss chords. A central aperture is formed in each of the plates having an annular rim to yield an increased bearing surface for the plates. In this regard, the '532 patent further discloses the use of a hollow sleeve which extends through the web members and into the central aperture of the plate to transfer the load exerted on the web members directly to the plates.

U.S. Pat. Nos. 3,330,087 and 3,336,706 disclose the use of a hollow cylindrical pin of high strength material which fits snugly within the registered openings of the chord and web. These pins are particularly adapted to be used in conjunction with bearing clips at the terminal ends of the truss. In this construction, the vertical load of the truss is transferred through the web and hollow pin, to the support provided by the bearing clips.

One disadvantage of the above structures is that the diameter of the aperture through the web members must be approximately the same size as the opening in the chord. Thus, the obtainable bearing area in the wood chords is limited by the size of the web apertures. Another disadvantage is that external washers are required to lock the pins in place. Finally, the metal pins may cause the wood to splinter upon insertion, do not conform to irregularities in the chord openings, and provide no vibrational or sound absorption.

Thus, although trusses have existed for over a century, there still remains a need for an improved means to effect the web/chord joint.

SUMMARY OF THE INVENTION

The disclosed invention employs cylindrical resilient bushings to obviate the problems inherent in prior methods of joining the metal webs and wooden chords in a truss joist structure. The inventive bushings may be used in either a single or double chord truss joist. In the double chord assembly, a resilient bushing having a central bore fits coaxially in each opening in the juxtaposed lumber sections. The apertures in the ends of the metal webs are approximately the size of the bushing bores and thus are of smaller diameter than the lumber openings. The web end apertures and bushing bores are registered by placing the webs between each juxtaposed lumber section pair. A pin extends through the lumber section openings and the web aperture to secure the lumber sections to each other and the web to each lumber section.

In a single chord assembly, a pair of resilient bushings are positioned within the transverse opening in the chord so that the bushings are separated by the slot into which the overlapped web ends extend. The bores of the bushing are registered with the apertures in the web ends. A pin is then used to penetrate the web apertures and bushing bores to secure the webs to the chord.

The bushing is made of a resilient material such as plastic. Thus, insertion of the bushing into the chord openings will not damage the wood as a metal pin may. Insertion of the pin into the bore of the bushing causes the bushing to expand somewhat thereby achieving a full fit within the chord opening, and an interlock between the bushing and chord. Thus, the need for external assemblies, such as locking washers, is eliminated. Importantly, the resiliency of the bushing also allows it to absorb sound and vibrations. Moreover, the resiliency allows a greater margin for manufacturing tolerances.

The bushing also serves to distribute the compression loads on the truss joist over a larger area of the wooden chord. Thus, if desired, a smaller diameter pin may be used allowing the ends of the webs to be kept reasonably small. Moreover, the desired bearing area in the wood may be achieved simply by varying the size of the bushing without affecting the size of the pin or web aperture.

Finally, the web/chord joint is easily assembled by either hand or hydraulic pressure.

In specific embodiments of the invention, the bushings are specifically manufactured to grip the chord when positioned within the chord opening. The pins may also be adapted to self-lock within the bushing bore.

DESCRIPTION OF THE DRAWINGS

These and other advantages will become more apparent from the following detailed description and the following drawings in which:

FIG. 1 is a fragmentary perspective view of a double chord truss joist assembly, partially in phantom to illustrate the inventive bushings' position within the lumber section openings;

FIG. 2 is a fragmentary perspective view of the web/chord joint area of a single chord truss joist assembly, partially in phantom to show the pair of bushings positioned within the chord section opening and separated by the chord slot;

FIG. 3 is a fragmentary side view of the web/chord joint area of a double chord truss joist assembly, partially in phantom to illustrate the overlapping metal web ends and bushing;

FIG. 4 is a sectional view taken along the line 4—4 of FIG. 3 and illustrates the use of a full length pin having beveled ends;

FIG. 5 is a sectional view of the web/chord joint area of a double chord truss joist illustrating the use of a short pin having beveled ends with a plastic bushing having an air vent;

FIG. 6 is a side view of the pin shown in FIG. 4;

FIG. 7 is a side view of the short pin shown in FIG. 5;

FIG. 8 is a side view of a screw bolt with a flared head;

FIG. 9 is a perspective view of a first embodiment of the inventive bushing;

FIG. 10 is a side view, partially cut away, of a tapered bushing;

FIG. 11 is a perspective view of a bushing embodiment having weakened walls;

FIG. 12 is a perspective view of a bushing embodiment having an expansion cut;

FIG. 13 is a perspective view of a bushing embodiment having an irregular exterior surface; and FIG. 14 is a cross-sectional view of a pair of bushings shaped to accommodate the screw bolt shown in FIG. 8.

DETAILED DESCRIPTION OF THE PREFERRED EMBODIMENTS

Referring to FIG. 1, a double chord truss joist assembly 10 is shown having an upper chord section 12 spaced from a lower chord section 14. The upper chord section 12 has two juxtaposed lumber sections 16 and 18 placed side by side, parallel to each other. In a like manner, the lower chord section 14 has two juxtaposed lumber sections 20 and 22. Lumber sections 16, 18, 20, and 22 are typically 2×4's or 2×6's. AS is well known, the actual dimension of a 2×4 is approximately $1\frac{1}{2}$ inches by $3\frac{1}{2}$ inches while that of a 2×6 is $1\frac{1}{2}$ inches by $5\frac{1}{2}$ inches.

Diagonally spanning the upper chord section 12 and lower chord section 14 are a series of metal webs 24, 26, and 28, arranged in a zig-zag relation. Each metal web 24, 26, and 28 has flattened ends. For example, the web 24 has an upper flattened end 30 and a lower flattened end 32. Similarly, the web 26 has an upper flattened end 34 and a lower flattened end 36. The flattened upper ends 30 and 34 of the adjacent web members 24 and 26 overlap at the joint area. The metal webs 24, 26, and 28 are typically $\frac{1}{2}$-inch or $\frac{1}{4}$-inch tubes for 2×4 chord sections and $1\frac{1}{4}$ inches or $1\frac{1}{2}$ inches tubes for 2×6 chord sections. The thickness of the flattened end sections 30, 32, 34, and 36 varies with the gauge of the steel.

Referring to FIGS. 4, 6, and 9, the web/chord joint will not be described. The lumber section 16 has an opening 38 extending therethrough. In a like manner, the lumber section 18 has an opening 40 extending therethrough. The openings 38 and 40 are registered. The upper flattened end 30 of the web 24 has an aperture 42 and the flattened upper end 34 of the web 26 has an aperture 42. The diameter of the apertures 42 and 44 are smaller than the diameter of the openings 38 and 40.

Referring to FIG. 9, a cylindrical bushing 43 is shown having a centrally located bore 45 extending through its length. As shown in FIG. 4, the bushings **43*a*, 43*b*, are positioned within the openings 38, 40 with the bores 45*a*, 45*b* coaxially aligned. The outer diameter of the web end apertures 42 and 44 are registered with the bushing bores 45*a*, 45*b***.

A full length pin 46, as shown in FIG. 6, extends through the web ends 30 and 34 and lumber sections 16 and 18. The full length pin 46 has a smooth cylindrical central section 48 and irregular or beveled ends 50 and 52. The flattened web ends 30 and 34 surround and directly contact the central section 48 of the full length pin 46. The length of the central section 48 may vary, depending upon the size of the metal webs 24 and 26 used. The beveled end 50 extends substantially completely through the length of bushing **43*a*. Similarly, the beveled end 52 extends substantially through the bushing 43*b* in lumber section 18. The beveled ends 50, 52 of the pin 46 are approximately $1\frac{1}{2}$ inches in length. The bevels on the ends 50 and 52 provide a means for the pin 46 to grip the bushings 43*a* and 43*b***. Thus, the bushing/-pin assembly is self-locking upon pin insertion and there is no need for an external assembly, such as a locking washer.

The method of assembling the truss joist assembly 10 will now be described. First, the bushings **43*a* and 43*b* are coaxially positioned within the openings 38 and 40. The beveled section 52 of the pin 46 is then driven into the bore 45*b* of the bushing 43*b*. Next, the webs 24 and 26 are threaded onto the pin 46 so as to be in contact with the central portion 48. The lumber section 16 containing the bushing 43*a* is then pounded or pressed onto the pin 46 so that the beveled section 50 extends substantially through the bushing bore 45*a*. The insertion of the pin 46 into the bushing bores 45*a*, 45*b* expands the bushings 43*a*, 43*b* within the openings 38, 40. This expansion locks the bushings 43*a*, 43*b* within the openings 38, 40. Moreover, the bevels on the ends 50, 52 of the pin 46 grip the bushings 43*a*, 43*b* upon insertion. Thus, the resiliency of the bushings and the unique structure of the pin 46** results in a pin/chord assembly which is self-locking upon pin insertion and require no external assembly such as locking washers.

Since the bushings **43*a* and 43*b* are larger in diameter than the web apertures 42 and 44, the compression load upon the truss joist assembly 10 is distributed over a larger area of the lumber sections 16 and 18. This reduces the chance of the pin 46 shearing the lumber sections 16 and 18 at the joint area. The desired bearing area can therefore be achieved by varying the diameter of the bushings. Ordinarily, a truss will require a larger bearing area at its ends than at its midsection. Thus, a larger diameter bushing will normally be used on the ends of the truss. As shown in FIG. 4, the outer diameter of the bushings 43***a*, 43*b* is greater than the diameter of the webs 24, 26. The thickness of the bushing, i.e. the distance between its inner and outer diameter, will normally be about ⅛-inch but can be varied if desired. The increased bearing area, provided by the bushing, allows the use of a smaller diameter pin if desired. This means that the web end apertures 42 and 44 can be reduced in size.

Importantly, the resiliency of the bushings allows them to absorb sounds and other types of vibrations. Thus, the shock of imbalanced or impact loads is effectively reduced and, the working of the pin/web connections is more quiet.

Referring now to FIGS. 5 and 7, an alternative embodiment of the joint assembly area in a double chord truss joist assembly is shown. In FIG. 5, the lumber sections 16, 18 are shown having the openings 38, 40. Positioned between the lumber sections 16 and 18 are a web 54 and a web 56. The web 54 has a flattened end 58 and the web 56 has a flattened end 60. The flattened ends 58 and 60 are overlapped. The flattened end 58 has an aperture 62 and the flattened end 60 has an aperture 64. The aperture 62 and the aperture 64 are registered with the opening 38 and the opening 40. Positioned within the opening 38 in the lumber section 16 is a bushing 66*a*. The bushing 66*a* has a bore 68 which extends only partially through the length of the bushing 66*a*. An air vent channel 70*a* extends from the base of the bore 68*a* to the atmosphere. The purpose of the air vent 70*a* will hereinafter be described.

In a like manner, a bushing 66*b* is positioned within the opening 40 in the lumber section 18. The bushing 66*b* has an air vent channel 70*b* and a bore 68*a* which extends only partially through its length.

A shorter length pin 72, as shown in FIG. 7, is positioned within the bushings 66*a*, 66*b* and web apertures 62, 64. As shown in FIG. 7, the pin 72 has a smooth central area 74 and beveled ends 76 and 78. The ends 76 and 78 are less than 1½ inches in length. The central area 74 is shorter than the central area 48 of the pin 46. This permits the use of the webs 54 and 56 which are of smaller diameter than the webs 24 and 26. Thus depending upon truss application, the web diameter may be varied and the corresponding appropriately sized pin selected.

The assembly of the joint area, shown in FIG. 5, will now be described. First, bushing 66*b* is positioned within the opening 40 in lumber section 18. The beveled section 78 of the pin 72 is then driven into the bore 68*b* of the bushing 66*b*. As the pin 72 is driven into the bore 68*b*, air contained in the bore 68*b* escapes out the air vent 70*b* to the atmosphere. Without the air vent 70*b*, air within the bore 68*b* would tend to become trapped as the beveled section 78 is driven further into the bushing 66*b*. This trapped air would tend to prevent the pin 72 from fully penetrating the length of the bore 68*b*. The webs 54 and 56 are then threaded onto the pin 72 and contact the central section 74. The bushing 66*a* is positioned within the opening 38 in the lumber section 16. The lumber section 16 is then driven onto the beveled section 76 of the pin 72. The beveled exterior of the end sections 76 and 78 of the pin 72 grip the exterior of the bushing bores 68*a* and 68*b*, tending to lock the lumber sections 16 and 18 together. In this embodiment, the end sections 76 and 78 of the pin 72 do not extend completely through the lumber sections 16 and 18. This helps prevent the pin 72 from resting. Thus, a minimum of exterior of the pin 72 is exposed to the environment.

Referring to FIG. 2, the web chord joint area of a single chord truss joist assembly will now be described. The single chord assembly, shown generally as 80, has a lower chord section 82 which has a slot 84 cut substantially through its width. The lower chord section 82 can be a laminated chord, made of continuous long parallel veneers, as is well know. Spaced from the lower chord section 82 will be an upper chord section (not shown) having a slot (not shown) opposing the slot 84. As will be understood, the web members 86 and 88 diagonally span the lower chord section 82 and upper chord section (not shown) in a zig-zag relation. The web 86 has a flattened end 90 and the web 88 has a flattened end 92. It will be understood that each of the web ends 90 and 92 also have an aperture as described in relation to the webs 24 and 26. The web ends 90 and 92 are overlapped with their apertures registered. The lower chord section 82 has a transverse opening 94 drilled substantially through its depth in communication with the slot 84. A pair of bushings, such as the bushings 42 shown in FIG. 9, are positioned within the opening 94 and are separated by the slot 84. A standard pin is then driven into the opening 94 through the bores of the bushings and the apertures of the web ends 90 and 92.

It should be understood that with a single chord truss joist assembly, pins with beveled ends, such as those shown in FIGS. 6 and 7, would not be used. Rather, a standard pin without beveled ends would be used as is well known to those skilled in the art. It also should be understood that bushings with bores that extend only partially through their length, as shown in FIG. 5, also could not be used.

A third type of pin 96, which can be used in the single and double chord truss joist assemblies, is shown generally in FIG. 8. The pin 96 is a screw bolt having a flared head 98, a smooth central portion 100, and a threaded end 102. The screw bolt 96 can be used in conjunction with a pair of bushings, as shown in FIG. 14. The pair of bushings, shown in FIG. 14, comprise a head bushing 104 and a tail bushing 106. The head bushing 104 has a central bore 108 extending through its length. The shape of the central bore 108 is shaped to conform to the head 98 and the smooth central portion 100 of the screw bolt 96. Similarly, the tail bushing 106 has a central bore 110 which is shaped to conform to the threaded end portion 102 of the screw bolt 96. The bore 110 is not threaded in its manufactured state, however, when the screw bolt 96 is screwed into the tail bushing 106, the threads of the threaded end portion 102 bite into the tail bushing 106, thereby locking the screw bolt 96 within the head bushing 104 and tail bushing 106.

Other types of specially manufactured bushings can be employed which provide different means to lock the particular bushing within the opening in the chord section. Referring to FIG. 10, a tapered bushing 112 is shown having a centrally located bore 114 extending through its length. The circumference of the bushing 112 gradually increases from left to right. The small diameter end of the bushing 116 is inserted into the opening in the chord section. The opening in the chord section will be sized to be slightly smaller than the largest circumference of the bushing 112 at its larger circumference end 118. Thus, as the bushing 112 is pounded into the chord opening, the bushing 112 will come wedged within the opening thereby locking it in place.

Referring to FIG. 11, a bushing 120 is shown which has a central bore 122 extending through its length. The walls of the bushing 120 have radially oriented slits 124 in them. These slits produce a weakness in the walls of the bushing 120. Thus, when a pin is driven into the bore 122 of the bushing 120, the weakened walls of the bushing 120 tend to expand. The expansion of the bushing 120 within the chord opening thereby locks it in place.

Referring to FIG. 12, a bushing 126 is shown which has a central bore 128 extending through its length. A slot 130 is cut through one section of the wall of the bushing 120 through its length so as to be in communication with the bore 128. Thus, as a pin is driven into the bore 128 of the bushing 126, the bushing 126 tends to expand as a result of the weakness caused by the slot 130. This expansion locks the bushing in place.

Referring to FIG. 13, a bushing 132 is shown having a central bore 134 extending through its length. The exterior of the bushing 132 has upraised ridges 136 which provide an irregular surface contact with the chord section which contacts the bushing. These upraised ridges 136 therefore provide a means to lock the bushing 132 within the chord section.

The length of the various bushings, shown in FIGS. 5, 9, 10, 11, 12, 13, and 14, is approximately 1½ inches. This is a typical length for wood and may vary for beams prefabricated of long parallel veneers.

I claim:

1. A truss joist assembly comprising:

(a) two spaced chord sections, each of said chord sections having an opening;

(b) a metal web diagonally spanning said chord sections between said openings, each end of said web having an aperture which is of smaller diameter than said chord section openings, each said web aperture being registered with one of said chord section openings;

(c) resilient means for absorbing vibrations to said truss joist assembly, said vibrational absorbing means being positioned within at least one of said chord section openings and having a bore coaxial with said chord section opening;

(d) a pin penetrating said web aperture and said bore to secure said web to said chord sections.

2. A truss joist assembly comprising:

(a) two spaced chord sections, each of said chord sections having an opening;

(b) a metal web diagonally spanning said chord sections between said openings, each end of said web having an aperture which is of smaller diameter than said chord section openings, each said web aperture being registered with one of said chord section openings;

(c) resilient bushing means for absorbing vibrations positioned within at least one of said chord section openings, said bushing means having a bore coaxial with said chord section opening; and (d) a pin penetrating said web aperture and said bore to secure said web to said chord sections.

3. The device of claim 2 wherein the bore of said bushing means extends partially through its length, said bushing means having an air vent to allow air to escape to atmosphere when said pin is driven into said bore.

4. The device of claim 2 wherein the exterior of said bushing means is irregular to grip said chord when said bushing means is positioned within said chord section opening.

5. The device of claim 2 wherein said bushing means has a slit along its length through the wall of the bushing means in communication with said bore to permit said bushing means to expand within said chord section opening when said pin penetrates said bore.

6. The device of claim 2 wherein said bushing means has weakened walls to permit said bushing means to expand within said chord section opening when said pin penetrates the bushing means bore.

7. The device of claim 2 wherein the circumference of said bushing means gradually decreases producing a first end of smaller circumference than a second end, said second end being of a circumference larger than the circumference of said chord section opening to permit said bushing means to be wedged within said chord section when said first end is driven into said opening.

8. The device of claim 2 wherein said pin has a beveled end which grips said bushing means upon insertion.

9. A truss joist assembly, comprising:

(a) two spaced chord sections, each of said chord sections having an opening;

(b) a metal web diagonally spanning said chord sections between said openings, each end of said web having an aperture which is of smaller diameter than said chord section opening, each said web aperture being registered with one of said chord section openings;

(c) a pair of resilient bushing means for absorbing vibrations positioned within at least one of said chord section openings, said bushing means having bores coaxial with said chord opening and said web end being positioned between said pair of bushing means; and (d) a pin penetrating said web aperture and the bores of said bushing means pair to secure said web to said chord section.

10. The device of claims 2 or 9 where the diameter of said bushing means is larger than the diameter of said web aperture.

11. The device of claim 4 wherein the bore of one of said bushing means is shaped to receive the head of a flared bolt and the other bore is sized to receive the threaded portion of said flared bolt.

12. In an assembly for mounting a metal web to a wooden chord member in a truss joist comprising two spaced chord sections, each of said chord sections having an opening, a metal web diagonally spanning said chord sections between said openings, said web having ends with apertures, said web and apertures in said chord section openings being registered, the improvement comprising:

(a) a pair of bushings positioned within one of said chord section openings, said chord section openings being larger in diameter than said web end apertures, said web ends being positioned between said pair of bushings, said bushings having bores coaxial with said chord section openings:

(b) a pin extending through said apertured web end into said bushing bores to secure said web to the chord sections; and (c) said bushings prohibiting contact between said pin and said chord section openings.

* * * * *